US008443707B2

(12) United States Patent
Skurdal et al.

(10) Patent No.: US 8,443,707 B2
(45) Date of Patent: May 21, 2013

(54) SELF-CONTAINED MUNITION GAS MANAGEMENT SYSTEM

(75) Inventors: Daniel A. Skurdal, Joppa, MD (US); John Snediker, Felton, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 248 days.

(21) Appl. No.: 12/862,287

(22) Filed: Aug. 24, 2010

(65) Prior Publication Data

US 2012/0152090 A1 Jun. 21, 2012

(51) Int. Cl.
*F41F 3/073* (2006.01)

(52) U.S. Cl.
USPC ..... 89/1.8

(58) Field of Classification Search
USPC ..... 89/1.8, 1.816, 1.817, 1.819
See application file for complete search history.

(56) References Cited

U.S. PATENT DOCUMENTS

| | | | | |
|---|---|---|---|---|
| 3,089,389 | A | 5/1963 | Andrews | |
| 3,106,132 | A | 10/1963 | Biermann et al. | |
| 3,110,464 | A | 11/1963 | Baratoff et al. | |
| 3,468,213 | A | 9/1969 | Hersh et al. | |
| 4,586,421 | A | 5/1986 | Hickey et al. | |
| 4,646,617 | A | 3/1987 | Robinson | |
| 4,665,792 | A | 5/1987 | Gassler et al. | |
| 4,934,241 | A * | 6/1990 | Piesik | 89/1.817 |
| 5,327,809 | A | 7/1994 | Matteson et al. | |
| 5,742,609 | A | 4/1998 | Kondrak et al. | |
| 5,837,919 | A * | 11/1998 | Yagla et al. | 89/1.816 |
| 6,079,310 | A * | 6/2000 | Yagla et al. | 89/1.816 |
| 6,125,734 | A | 10/2000 | Yagla | |
| 6,142,055 | A | 11/2000 | Borgwarth et al. | |
| 6,230,604 | B1 | 5/2001 | Larson et al. | |
| 6,283,005 | B1 | 9/2001 | Yagla et al. | |
| 6,610,971 | B1 | 8/2003 | Crabtree | |
| 7,040,212 | B1 * | 5/2006 | Gaywood et al. | 89/1.801 |
| 2002/0096041 | A1 * | 7/2002 | Briggs et al. | 89/1.817 |

(Continued)

OTHER PUBLICATIONS

Tillman, Jr., Reginald S., "U.S. Appl. No. 12/274,409 Office Action Dec. 14, 2011", , Publisher: USPTO, Published in: US.

(Continued)

*Primary Examiner* — Bret Hayes
(74) *Attorney, Agent, or Firm* — Kaplan Breyer Schwarz & Ottesen, LLP

(57) ABSTRACT

An apparatus is disclosed that is a self-contained gas management system (hereinafter "GMS") that accommodates individual canisters of highly energetic small munitions, but is not so limited. By decoupling the gas management system for a given munition from an adjacent munition, the risk of downing a multi-pack launcher or munition adapter is reduced. Thermal wear, overheating, restrained firing and aft closure debris can be isolated through the separation of gas management systems. In addition, the GMS allows for ease of replenishment and maintenance of a given sub-cell of a multi-pack system. The GMS works with existing munitions and canisters without the need to modify them. Each GMS is dimensioned to fit the canistered munition it receives as well as the launch system with which it is used. The illustrative GMS comprises a plenum, and a first and a second uptake structure. The plenum receives the exhaust from the canistered munition when the munition fires. The plenum is fluidically coupled to the first and second uptake structures. The uptake structures in the illustrative embodiment receive the missile exhaust from the plenum and vent the exhaust to the atmosphere. In the illustrative embodiment, the first and second uptake structures are disposed along opposite sides of the canistered munition, flanking it.

25 Claims, 9 Drawing Sheets

U.S. PATENT DOCUMENTS

| | | | | |
|---|---|---|---|---|
| 2002/0189432 | A1 | 12/2002 | Facciano et al. | |
| 2003/0000371 | A1* | 1/2003 | Ciappi | 89/1.817 |
| 2005/0108917 | A1 | 5/2005 | Kunstmann | |
| 2009/0126556 | A1 | 5/2009 | Skurdal et al. | |
| 2012/0152090 | A1* | 6/2012 | Skurdal et al. | 89/1.8 |

OTHER PUBLICATIONS

Tillman, Jr., Reginald S., "U.S. Appl. No. 12/274,409 Office Action Apr. 29, 2011", , Publisher: USPTO, Published in: US.

Tillman, Jr., Reginald S., "U.S. Appl. No. 12/274,409 Panel Decision May 3, 2012", , Publisher: USPTO, Published in: US.

Tillman, Jr., Reginald S., "U.S. Appl. No. 12/274,409 Office Action Jul. 19, 2011", , Publisher: USPTO, Published in: US.

"BAE Systems MK25 Quad Pack", "http://web.archive.org/web/20071018171337/http://baesystems.com/ProductsServices/mk25_quad_pack.html XP002545342", Oct. 18, 2007, Publisher: BAE Systems.

Moorhead, Seth B., "The Latest in Ship Weapon Launchers—The Vertical Launching System", "Naval Engineers Journal XP002048251", Apr. 1981, pp. 90-96, vol. 93, No. 2, Published in: US.

Beaufume, Cedric, "PCT Application No. PCT/US2008/084115 International Search Report Oct. 1, 2009", , Publisher: EPO, Published in: EP.

Albuquerque, Savio, "AU Application No. 2008351349 Office Action Feb. 11, 2011", , Publisher: IPA, Published in: AU.

Giffo-Schmitt, Beate, "PCT Application No. PCT/US2008/084115 International Preliminary Report on Patentability Jul. 3, 2010", , Publisher: PCT, Published in: PCT.

Tillman, Jr., Reginald S., "U.S. Appl. No. 12/274,409 Advisory Action Sep. 1, 2011", Publisher: USPTO, Published in: US.

Tillman, Jr., Reginald S "U.S. Appl. No. 12/274,409 Panel Decision Nov. 1, 2011", , Publisher: USPTO, Published in: US.

Menier, Renan, "PCT Application No. PCT/US2011/047045 International Search Report Nov. 7, 2011", , Publisher: PCT, Published in: PCT.

Evans, David J., "GB Application No. 1009887.9 Office Action Mar. 26, 2012", , Publisher: UK IPO, Published in: GB.

Tillman, Jr., Reginald S., "U.S. Appl. No. 12/274,409 Office Action Feb. 16, 2012", Publisher: USPTO, Published in: US.

Tillman, Jr., Reginald S "U.S. Appl. No. 12/274,409 Office Action Dec. 20, 2010", , Publisher: USPTO, Published in: US.

* cited by examiner

RETROFITTED MULTI-CELL LAUNCHER
100

SELF-CONTAINED MUNITION GAS MANAGEMENT SYSTEM

FIELD OF THE INVENTION

The present invention relates to missile launchers, and more particularly to vertical missile launchers.

BACKGROUND OF THE INVENTION

Modern warships use guided missiles as their principal offensive and defensive weapons. Since a naval engagement may be protracted, a warship must have many missiles available for immediate launch. This need has been addressed by multiple-missile launchers, in which plural launch cells (e.g., eight cells, etc.) are loaded with missiles that can be individually launched.

There is also a need to launch, from a single multiple-missile launcher, missiles of different mission type. This need has been met, for example, by the below-deck, vertical MK 41 and MK 57 missile launchers. These launchers accept canisterized (or canistered) missiles, wherein the missiles can be one of several types. The canisters are loaded into corresponding canister-holding chambers or cells in the missile launcher. Each canistered missile has a standardized connector, which is connected within each cell, to a launch sequencer. The launch sequencer is an electronic assembly that identifies the missile within the canister by interrogating a code that is associated with the canister. The launch sequencer also responds to arming and firing signals from a higher level of control by generating a sequence of signals for the identified missile (e.g., firing signals, safe signals, etc.). These signals are transmitted via an umbilical cable to the canister and the missile within it to control launch.

A major roadblock to providing new munitions capability to naval fleets is the extremely high cost of launcher-related modifications. Specifically, integration of a new munition into an existing main battery launching system typically requires the design and qualification of a new canister for packaging, handling, storing, and transporting the munition. Furthermore, existing main battery host-launcher electronics and software must be appropriately modified to provide power and interfacing to each of the munition rounds in the newly developed canister. Additionally, integrating a new munition typically requires re-qualifying the gas management system of the launcher for the new munition.

One solution that is beneficial to reducing the cost of integrating new munitions in existing main-battery launchers is the "Adaptable Launch System" (hereinafter "ALS"). The ALS is described in U.S. Pat. No. 8,397,613 (application Ser. No. 12/274,409, filed on Nov. 20, 2008, which published as U.S. Patent Application Publication no. 2009/0126556 A1, titled "Adaptable Launching System," and which is incorporated by reference in its entirety herein. In some embodiments, the ALS is used as a stand-alone launcher. In some other embodiments, the ALS is used as a "guest" launcher in one or more cells of a multi-cell "host" launching system, such as the MK 41 or MK 57 VLS main-battery launchers. In both stand-alone and guest-launcher applications, the ALS can accommodate either a single munition or a "multi-pack" of smaller munitions in its single launch cell.

FIG. 1A depicts retrofitted multi-cell launcher ("RMCL") 100, which includes multi-cell multi-munition launcher ("MCL") 102 and ALS 112. In the embodiments depicted herein, MCL 102 is a MK 41 VLS main battery launcher that has been appropriately modified to operate with one or more ALS 112 units in its cells as guest launchers.

As depicted in FIG. 1A, MCL 102 is a fixed, vertical, multi-missile storage and firing system. The missile launcher consists of a single eight-cell missile module that is capable of launching a variety of different types of missiles. The eight-cell module comprises upright structure 104, which defines eight cells 106. In a typical MK 41 VLS unit, the cells provide vertical storage space for eight missile canisters. But in accordance with an illustrative embodiment of the ALS, one or more of cells 106 receive ALS 112 unit(s).

The MK 41 VLS as MCL 102 is installed below deck, such that only deck and hatch assembly 108 at the top of the module is visible from the deck of a ship. The deck and hatch assembly protects ALS 112 (or missile canisters in a conventional MK 41 VLS) during storage and the hatches open to permit munitions launch.

Electronic equipment 110 monitors and controls various components of MCL 102, distributes power signals originating from outside RMCL 100 to the one or more ALS 112 units, collects control and damage control signals from ALS 112 and transmits them to appropriate authorities, and assists in the launch of munitions from ALS 112 units.

The salient features of ALS 112 depicted in FIG. 1 include enclosure 114, munitions adapter 116, and launch control electronics 118. Enclosure 114 serves as a housing for munitions adapter 116 and launch control electronics 118. The munitions are launched from ALS 112 under the control of their own weapon control system ("WCS") through an instantiation of launch control electronics 118 that is tailored to that specific munition type. Launch control electronics 118 supplies electrical power to the munitions and manages the launch sequence. In most embodiments, the electrical power distribution subassembly and at least some cabling are not included in ALS 112 proper. Rather, these elements are associated with the host launcher.

FIG. 1B depicts the salient elements of the structure of enclosure 114 of the ALS 112 of FIG. 1A. Enclosure 114 comprises: top frame/seal 150; shell 151; munitions compartment 152; sealing bulkhead 153; electronics access way 154; electronics compartment 155; and bottom frame 156.

Top frame and module seal 150 cooperates with the ship's deck and hatch assembly 108 of MCL 102 (in FIG. 1A) to create a seal or to vent exhaust to the atmosphere, as appropriate.

Shell 151 meets the physical requirements (e.g., size, shape, etc.) of a canister of the vertical launch system hosting ALS 112. Shell 151 is formed from a material that meets appropriate standards that are well-known in the art, e.g., MIL-STD 2013, DDS 078-1, etc. Shell 151 is sized to accommodate both tactical length and strike length launcher applications.

Sealing bulkhead 153 (shown in phantom in the present figure) separates munitions compartment 152, which houses munitions adapter 116 (in FIG. 1A), from electronics compartment 155. Sealing bulkhead 153 prevents exhaust gases from entering into electronics compartment 155 and the launcher space of the ship.

Electronics access way 154 provides access to the electronics housed in electronics compartment 155.

Bottom frame 156 provides the supporting base for enclosure 114 and is physically connected to shell 151. More detail regarding ALS 112 and the elements of enclosure 114 is supplied in the above-cited disclosure.

However, for some types of munitions, the integration solutions and advantages provided by the ALS do not address the particular needs of those munitions.

SUMMARY OF THE INVENTION

The inventors of the present invention recognized that highly energetic munitions (e.g., rolling airframe missiles, Hellfire, etc.) have characteristics that the ALS and other weapons-integration solutions do not currently address. When fired, aft-venting munitions installed in a vertical launching configuration require a way to redirect exhaust gases. When the ALS is not used with the weapons system, a launch system that has its own sub-system for exhaust or gas management requires substantial retrofitting, or at the very least, substantial integration testing, to accommodate highly energetic munitions.

The inventors of the present invention recognized that, to sustain the viability of the ALS and other weapons-integration solutions for use with highly energetic munitions, the exhaust must be affirmatively re-directed and vented by a gas management system that is self-contained and accommodates the dimensions and characteristics of the respective munitions. By decoupling the gas management system for a given munition from an adjacent munition, the risk of downing a multi-pack launcher or munition adapter is reduced. Thermal wear, overheating, restrained firing and aft closure debris can be isolated through the separation of gas management systems. In addition, the GMS allows for ease of replenishment and maintenance of a given sub-cell of a multi-pack system. Some small highly energetic munitions types, such as rolling airframe missiles and Hellfire missiles, are particularly good candidates for the self-contained gas management system in accordance with the present invention.

The illustrative embodiment of the present invention is a self-contained gas management system (hereinafter "GMS") that removably receives a single canistered munition. In the illustrative embodiment, an ALS receives four GMSs. Each canistered munition is installed in a respective one of the four GMSs. Alternative embodiments that do not comprise ALS accommodate one or more GMSs in a vertical launch system cell or, alternatively, in another weapons platform that is integral to the ship.

The GMS principally comprises a plenum, a first uptake structure, and a second uptake structure. The GMS removably receives a single canistered munition. The plenum accepts the exhaust from the canistered munition when the munition fires. The plenum is fluidically coupled to the first and second uptake structures.

The uptake structures receive the missile exhaust from the plenum and vent the exhaust to the atmosphere. In the illustrative embodiment, the first and second uptake structures are disposed along opposite sides of the canistered munition, flanking it. In conjunction with brackets and other components that are disclosed in more detail below, the uptake structures and plenum collectively provide framing and structure for the GMS.

An enhanced munitions adapter is disclosed, for some embodiments that comprise a plurality of GMSs, wherein the enhanced munitions adapter accommodates the plurality of GMSs, each GMS accompanying a single canistered munition. The enhanced munitions adapter thus forms a "GMS multi-pack." In the illustrative embodiment, the ALS receives the enhanced munitions adapter and four canistered munitions installed in their respective GMSs.

The GMS has an "open" position for receiving and removing a canistered munition, and a "closed" position for installation into a launch system and firing the munition. Correspondingly, in some embodiments that comprise the enhanced munitions adapter, the enhanced munitions adapter also has "open" and "closed" positions.

The self-contained GMS disclosed herein has several advantages over the prior art, including, among others:

The GMS works with existing munitions without the need to modify the munitions or the canisters that house them. Each GMS is dimensioned to fit the canistered munition it receives as well as the launch system in which the GMS is used. Therefore, the GMS according to the illustrative embodiment is suitable for both existing munitions and new as-yet-undeveloped munitions.

In a launch system that operates with the ALS in a host/guest configuration, the GMS enables the use of highly energetic munitions with relatively minor modifications to the ALS, but without further modifications to the host launch system.

In an ALS that operates as a stand-alone launcher, i.e., without a host launcher, the GMS enables the use of highly energetic munitions with relatively minor modifications to the ALS.

In a launch system that operates without an ALS, the GMS enables the use of highly energetic munitions with relatively minor modifications to the launch system.

The GMS provides a lower cost of integration testing and re-qualification of a new munition.

Some embodiments, in particular those that do not incorporate an ALS, comprise: an apparatus for use in a vertical launch system, the apparatus comprising:

(a) a plenum that is capable of being fluidically coupled to a canistered munition, wherein the plenum receives the exhaust from the munition when the munition is fired; and (b) a first uptake structure that is fluidically coupled to the plenum, wherein the first uptake structure guides the exhaust from the plenum to the atmosphere;

wherein the apparatus removably receives the canistered munition, and wherein the apparatus is at least partially removable from the vertical launch system to receive the canistered munition, and wherein the dimensions of the plenum and of the first uptake structure are based on the dimensions of the canistered munition, and wherein the plenum and the first uptake structure collectively define a gas management system for the canistered munition.

Some other embodiments that incorporate an ALS comprise: an apparatus for use in a single-cell vertical launch system that is suitable for use as a guest launcher within a host launcher, the apparatus comprising:

an enhanced munitions adapter that accommodates a plurality of canistered munitions, wherein:

(i) each canistered munition is operatively coupled to a respective gas management system, and wherein each gas management system operates independently, (ii) a cell in the vertical launch system includes an enclosure for receiving the enhanced munitions adapter, (iii) the enclosure comprises a sealing bulkhead that separates the enclosure into a munitions compartment and an electronics compartment, (iv) the enhanced munitions adapter is disposed in the munitions compartment, and (vii) each gas management system comprises:

(a) a plenum that is capable of being fluidically coupled to a respective canistered munition, wherein the plenum receives the exhaust from the munition when the munition is fired, and (b) a first uptake structure that is fluidically coupled to the plenum, wherein the first uptake structure guides the exhaust from the plenum to the atmosphere; and wherein each gas management system removably receives the respective canistered munition;

wherein the dimensions of the plenum and of the first uptake structure are based on the dimensions of the respective canistered munition.

DETAILED DESCRIPTION

Figure 1A:
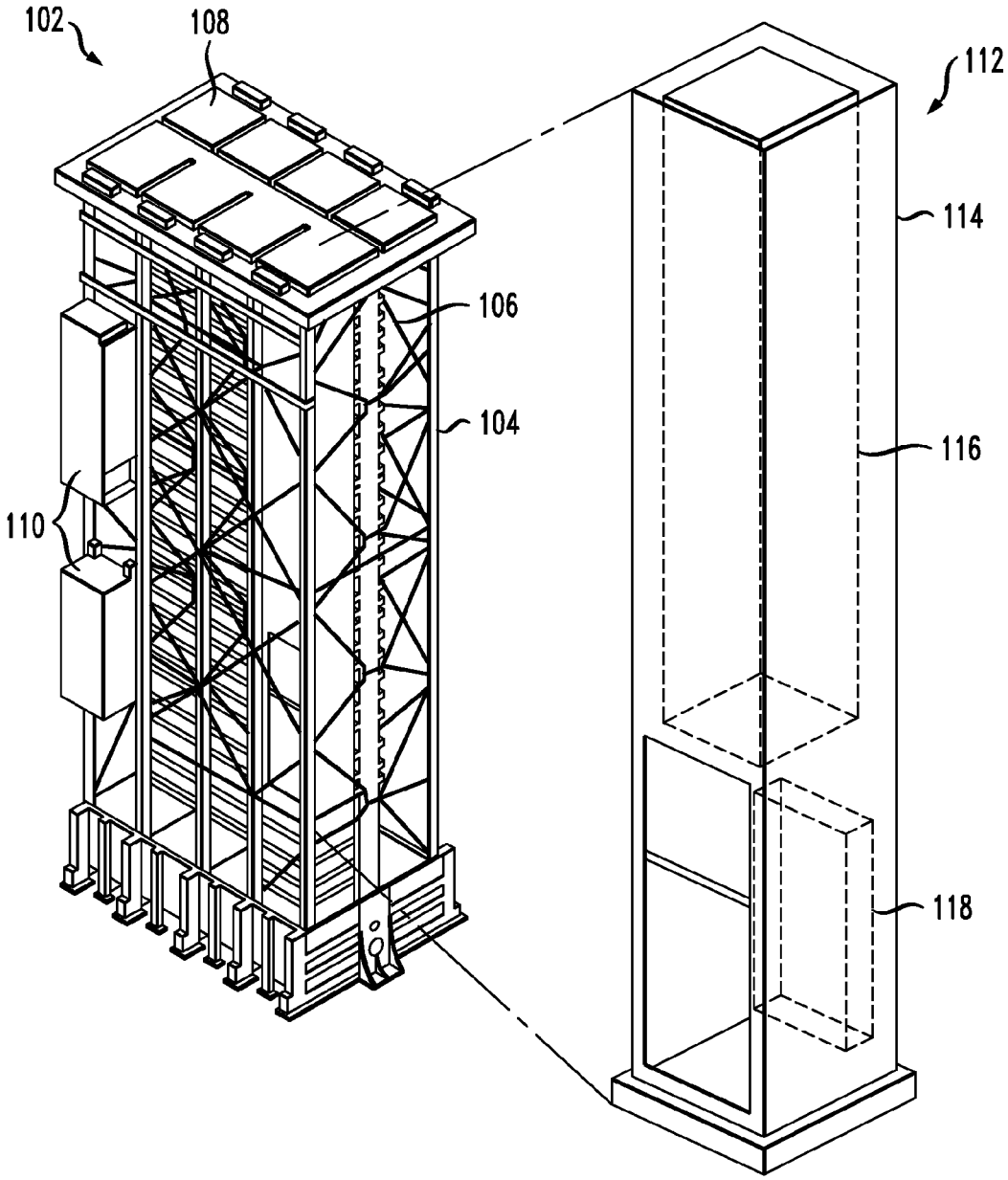
FIG. 1A depicts retrofitted multi-cell launcher ("RMCL") 100, which includes multi-cell multi-munition launcher 102 and adaptable launch system 112.
Figure 1B:
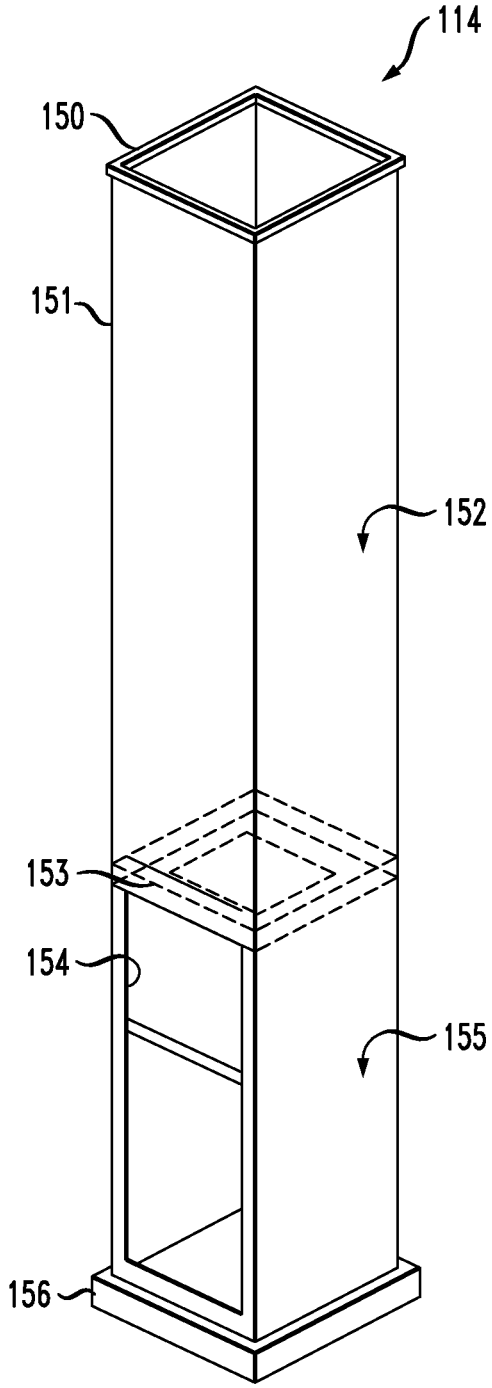
FIG. 1B depicts the salient elements of the structure of enclosure 114 of the adaptable launch system 112 of FIG. 1A.

The following terms are defined for use in this disclosure and in the accompanying claims:

The term "electrically-connected" means that two objects are in direct electrical contact without any intervening elements. In other words, the region of contact between the two objects remains at a substantially uniform voltage for substantially any current (neglecting any voltage drop due to the resistivity of the physical connection medium, such as a wire).

The term "electrically-coupled" means that two objects are in electrical contact. This can be via direct physical contact (e.g., a plug in an electrical outlet, etc.), via an electrically-conductive intermediate (e.g., a wire that connects devices, etc.), or via intermediate devices, etc. (e.g., a resistor electrically connected between two other electrical devices, etc.).

The term "enhanced munitions adapter" means the structure that accommodates a plurality of gas management systems (GMSs). It will be clear to those having ordinary skill in the art, after reading the present disclosure, that the enhanced munitions adapter is sometimes referred to herein as a "GMS multi-pack."

The term "fluidically coupled" and inflected forms mean that liquid, gas, or vapor from a first region can flow to or otherwise cause an effect in a second region. For example, if two regions are fluidically coupled (or in fluidic communication), a pressure change in one of those regions might (but not necessarily will) result in a pressure change in the other of the regions.

The term "operatively coupled" means that the operation of one element or device affects another device, wherein the devices need not be physically coupled. For example, a laser and a mirror are operatively coupled if a laser directs a beam of light to the mirror.

The term "physically connected" or "physically coupled" means in direct physical contact and affixed (e.g., a mirror that is mounted on a linear-motor).

The GMS disclosed herein can be used in a vertical launch system. The vertical launch system can comprise one launcher or a battery of launchers. Furthermore, the vertical launch system can comprise a guest launcher, such as an ALS, which is fitted into a main battery host system. The principles of the GMS disclosed herein suit any and all of these variations in launch systems. Therefore, the GMS of the present invention can operate in a variety of embodiments associated with various vertical launch system configurations.

The illustrative embodiment of the present invention is a single-cell vertical launching system ALS 112 that accommodates four canistered munitions each installed in its respective GMS in accordance with the present invention. In the illustrative embodiment, enclosure 114 removably receives a four-GMS multi-pack.

In alternative embodiments where the ALS 112 is not used, one or more of cells 106 of the MCL 102 is capable of removably receiving a missile canister with the accompanying GMS. In other alternative embodiments that do not include a contained superstructure such as ALS 112 or MCL 102, a uniquely fitted ship configuration is capable of removably receiving a missile canister with the accompanying GMS, or a plurality of missile canisters with a GMS multi-pack.

Figure 2:
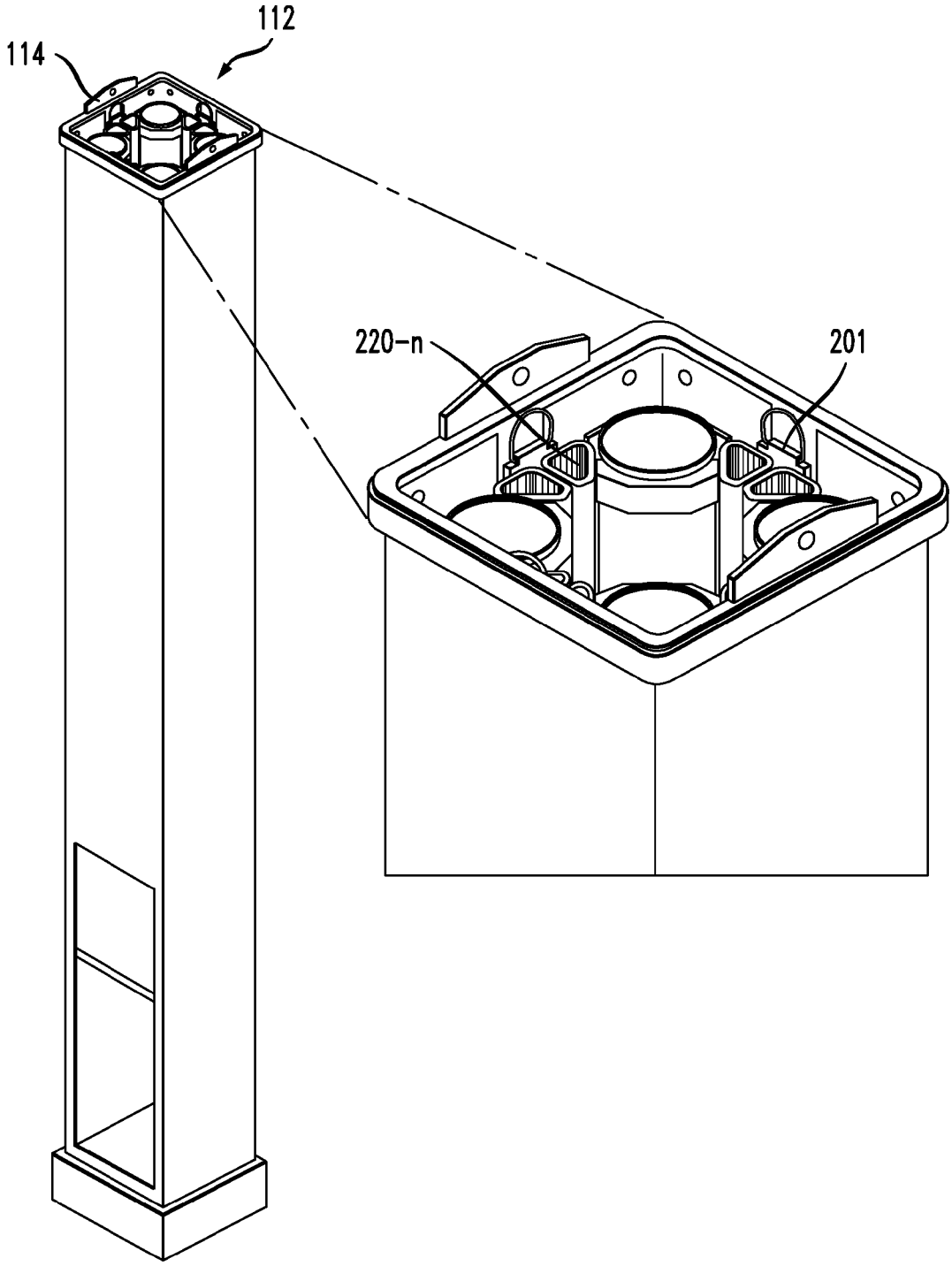
FIG. 2 depicts a loaded ALS 112 with a view of enhanced munitions adapter 201 accommodating four GMSs 220-*n* in accordance with an illustrative embodiment.

FIG. 2 depicts a loaded enclosure 114 of ALS 112 with a view of enhanced munitions adapter 201 accommodating four GMSs 220-*n* in accordance with an illustrative embodiment, wherein n=1, 2, 3, or 4. It will be clear to those having ordinary skill in the art, after reading the present disclosure, that any disclosure herein in respect to a component n applies equally to other components of the same kind.

All four GMSs are not fully visible in FIG. 2. The GMS 220-*n* is described in more detail in FIGS. 3-6. It will be clear to those having ordinary skill in the art, after reading the present disclosure, that a "GMS multi-pack" in the present disclosure comprises an enhanced munitions adapter 201.

In some embodiments that do not include a contained superstructure such as ALS 112 or MCL 102, the view of enhanced munitions adapter 201 depicted in FIG. 2 represents enhanced munitions adapter 201 in a ship configuration that is capable of removably receiving a plurality of missile canisters each accompanied by its respective GMS 220-*n*. Enhanced munitions adapter 201 is described in more detail in FIGS. 7 and 8.

Figure 3:
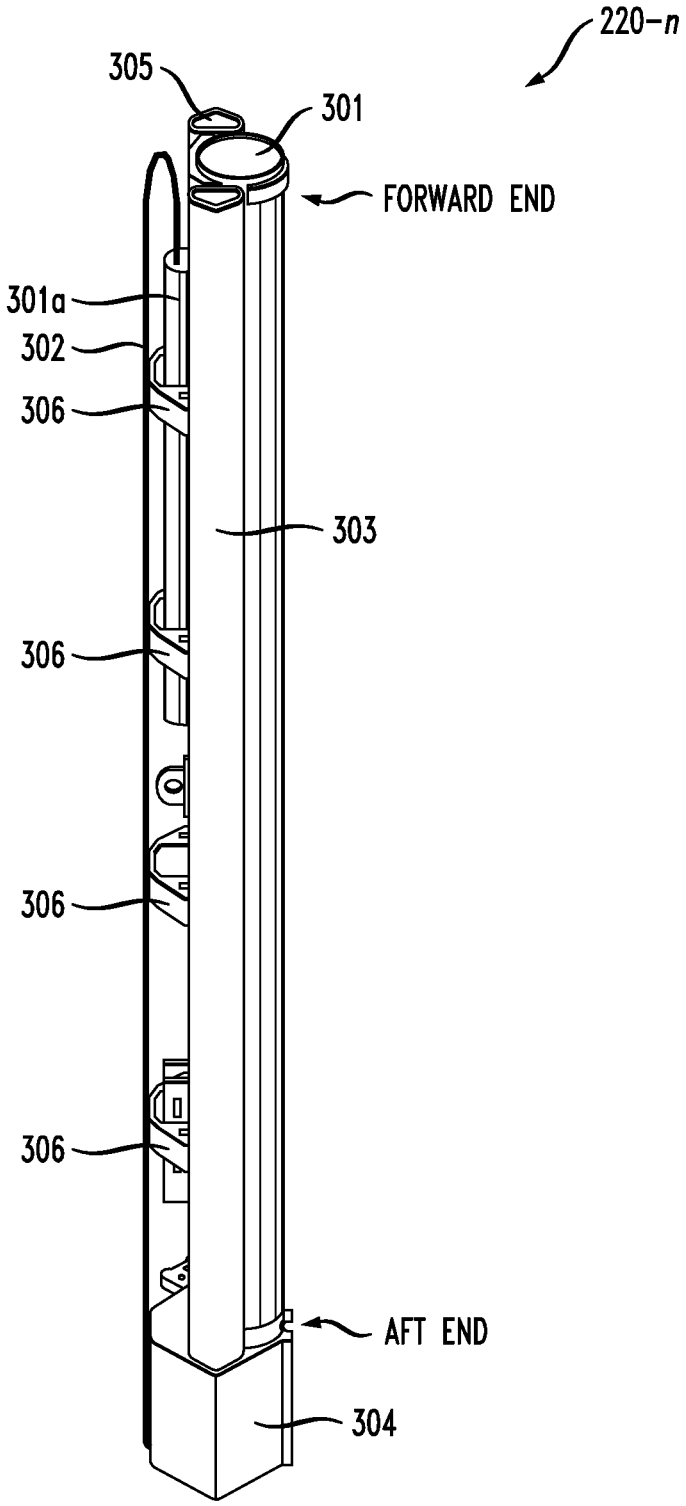
FIG. 3 depicts gas management system 220-*n* in accordance with an illustrative embodiment.

FIG. 3 depicts gas management system 220-*n* with canistered munition 301 installed, in accordance with an illustrative embodiment. GMS 220-*n* comprises: umbilical cable 302; uptake structure 303; plenum 304; uptake structure 305; and a plurality of bracket structures 306. As depicted in the present figure, GMS 220-*n* is in a "closed" position for installation into a launch system and firing the munition.

It is to be understood that GMS 220-*n* does not comprise canistered munition 301. GMS 220-*n* removably receives canistered munition 301. GMS 220-*n*, including its components, is dimensioned at least in part based on the dimensions of canistered munition 301.

Canistered munition 301 is depicted installed in GMS 220-*n*. Canistered munition 301 comprises electronics section 301*a*.

Umbilical cable 302 is an insulated electrical cable that is well-known in the art, that connects canistered munition 301 to launch control electronics 118 that is tailored to that specific munition type. Umbilical cable 302 enables canistered munition 301 to be electrically coupled to launch control electronics 118. Umbilical cable 302 connects to electronics section 301*a* of canistered munition 301.

Uptake structure 303 and uptake structure 305 each guides the exhaust from canistered munition 301 to the atmosphere. It will be clear to those having ordinary skill in the art, after reading the present disclosure, how to make and use alternative embodiments in which, after traveling through uptake structures 303 and 305, the exhaust reaches the atmosphere indirectly, such as by first reaching a hatch that opens to the atmosphere.

Uptake structure 305 is identical to uptake structure 303, and provides GMS 220-*n* with additional exhaust uptake capacity. It will be clear to those having ordinary skill in the art, after reading the present disclosure, how to make and use alternative embodiments of GMS 220-*n* that do not comprise uptake structure 305, or that comprise a different number of uptake structures, e.g., one uptake structure, three uptake structures, etc.

In the illustrative embodiment, uptake structures 303 and 305 are disposed along opposite sides of canistered munition 301, flanking it, but the invention is not so limited. Uptake structures 303 and 305 are dimensioned to accommodate the dimensions of the type of canistered munition for which GMS 220-*n* is designed.

Uptake structures 303 and 305 are each fluidically coupled to plenum 304, from which they receive the missile exhaust.

Plenum 304 receives the exhaust from canistered munition 301 when it is fired. Plenum 304 is fluidically coupled to uptake structures 303 and 305. The exhaust is guided from the aft end of canistered munition 301 towards the forward end of canistered munition 301 and thus, towards the corresponding forward end of the launch system. The exhaust travels from plenum 304 to uptake structures 303 and 305, and ultimately to the atmosphere. Plenum 304 is dimensioned based on the dimensions of canistered munition 301. In the illustrative embodiment, plenum 304 is positioned such that it supports, at least in part, canistered munition 301, but in some embodiments plenum 304 is positioned otherwise within GMS 220-*n*.

Bracket 306 is one of a plurality of brackets 306 in GMS 220-*n*. The illustrative embodiment comprises four brackets 306, but alternative embodiments can comprise any number of brackets 306, or no brackets. Each bracket 306 is physically connected to uptake structure 303 and to uptake structure 305 (connection not visible in this view). Brackets 306, in conjunction with uptake structures 303 and 305 and with other components that are described in more detail in FIGS. 5 and 6, collectively provide framing and structure to GMS 220-*n*, enabling it to receive and support canistered munition 301.

Figure 4:
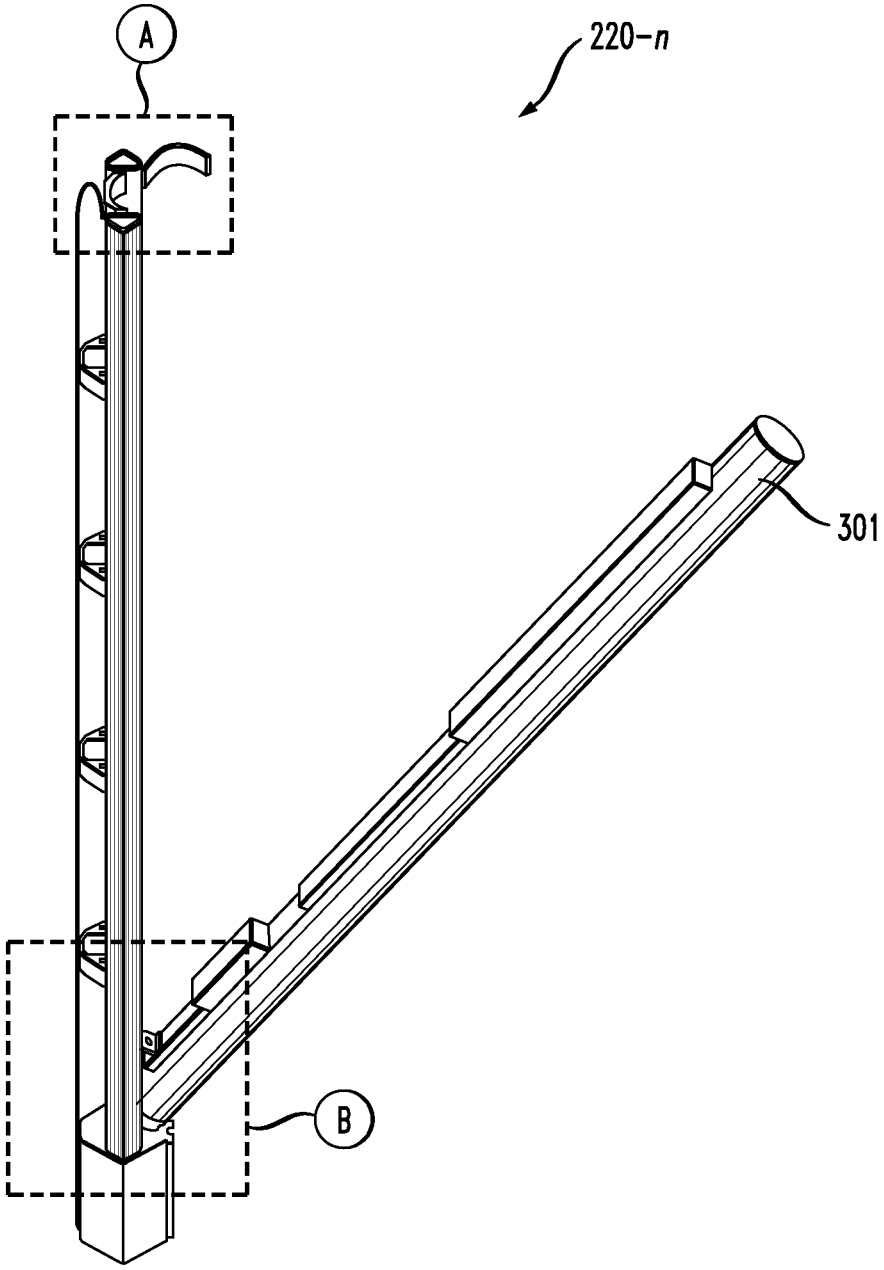
FIG. 4 depicts gas management system 220-*n* in an "open" position.

FIG. 4 depicts gas management system 220-*n* in an "open" position with canistered munition 301 installed. The "open" position of GMS 220-*n* enables the loading and unloading of canistered munition 301.

Canistered munition 301 is depicted installed in GMS 220-*n*.

Figure 7:
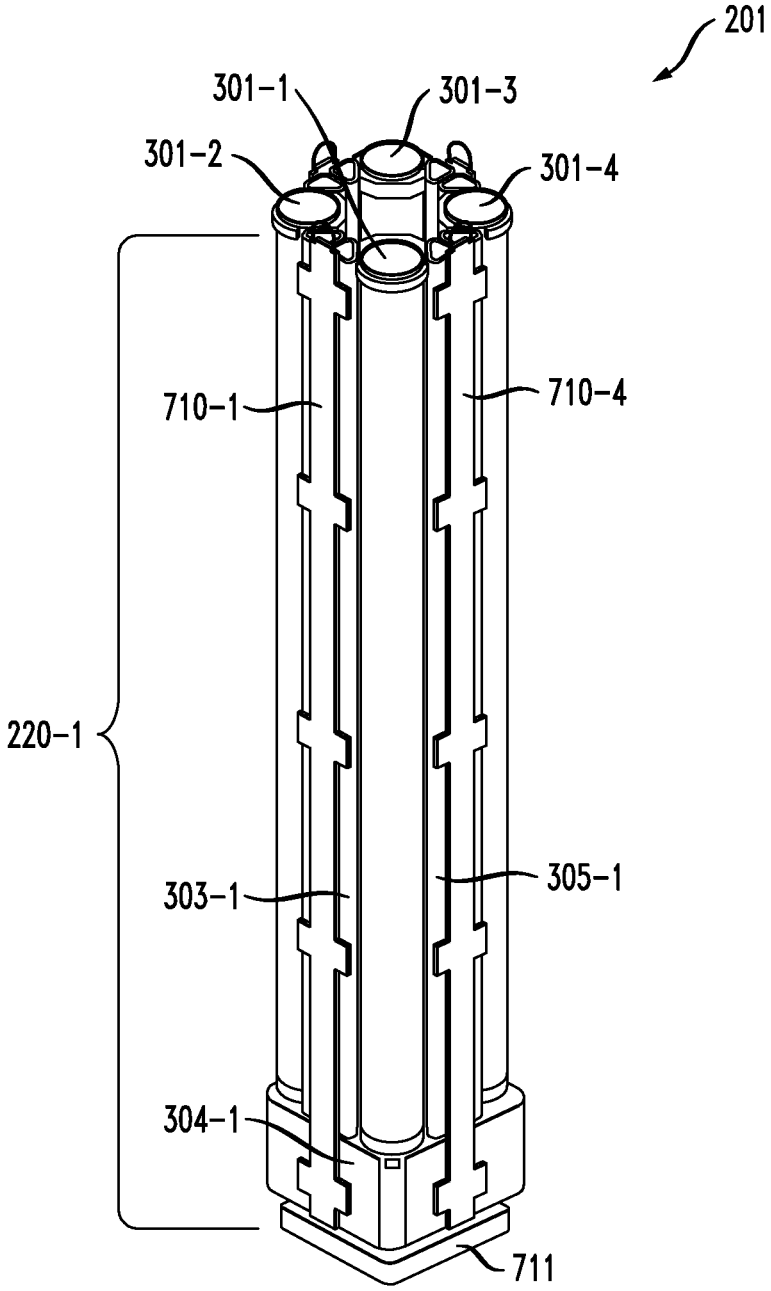
FIG. 7 depicts enhanced munitions adapter 201 accommodating four GMSs 220-*n* in accordance with an illustrative embodiment.

Detail "A" is shown and discussed in further detail in FIG. 7.

Figure 8:
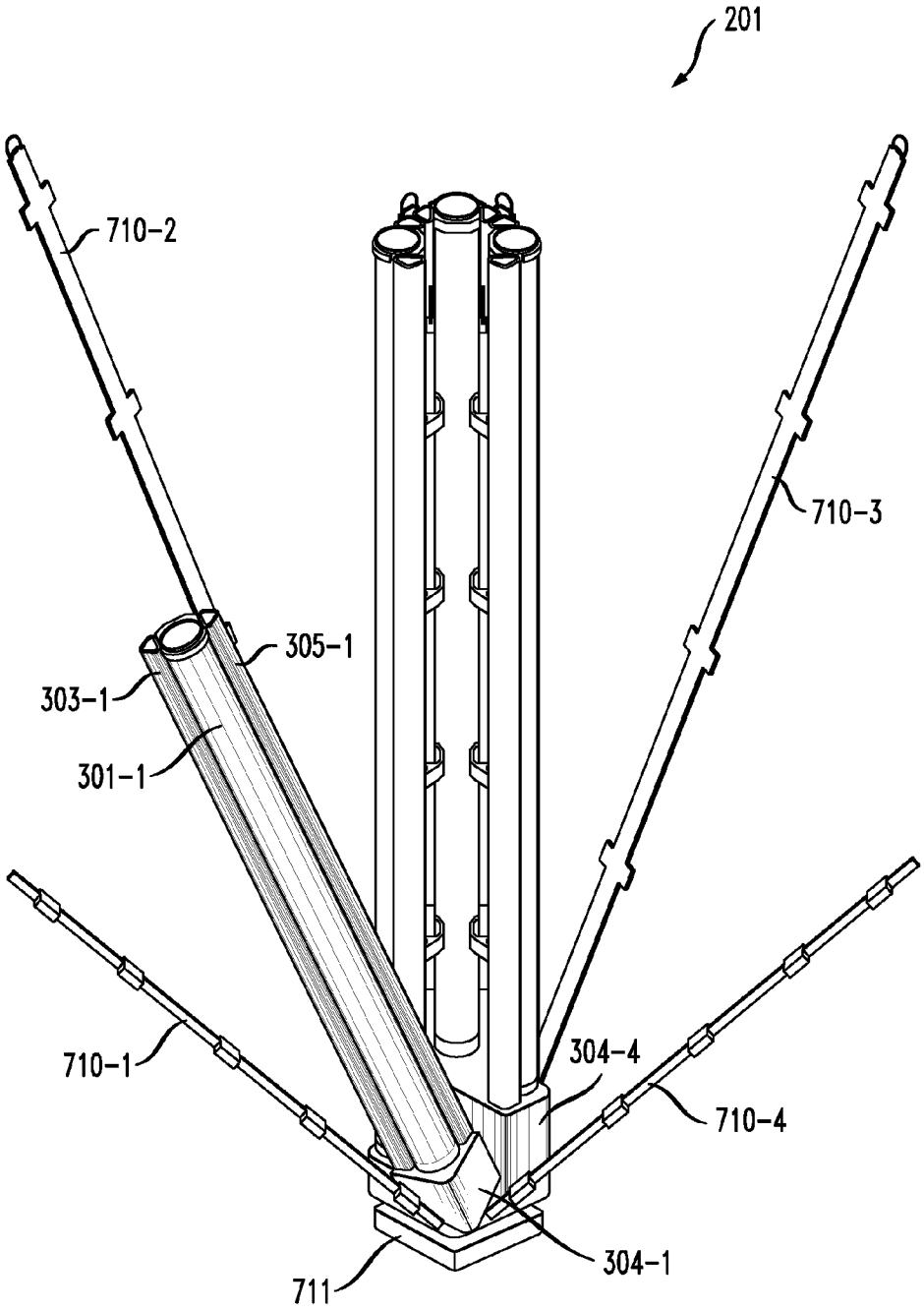
FIG. 8 depicts enhanced munitions adapter 201 in an "open" position.

Detail "B" is shown and discussed in further detail in FIG. 8.

Figure 5:
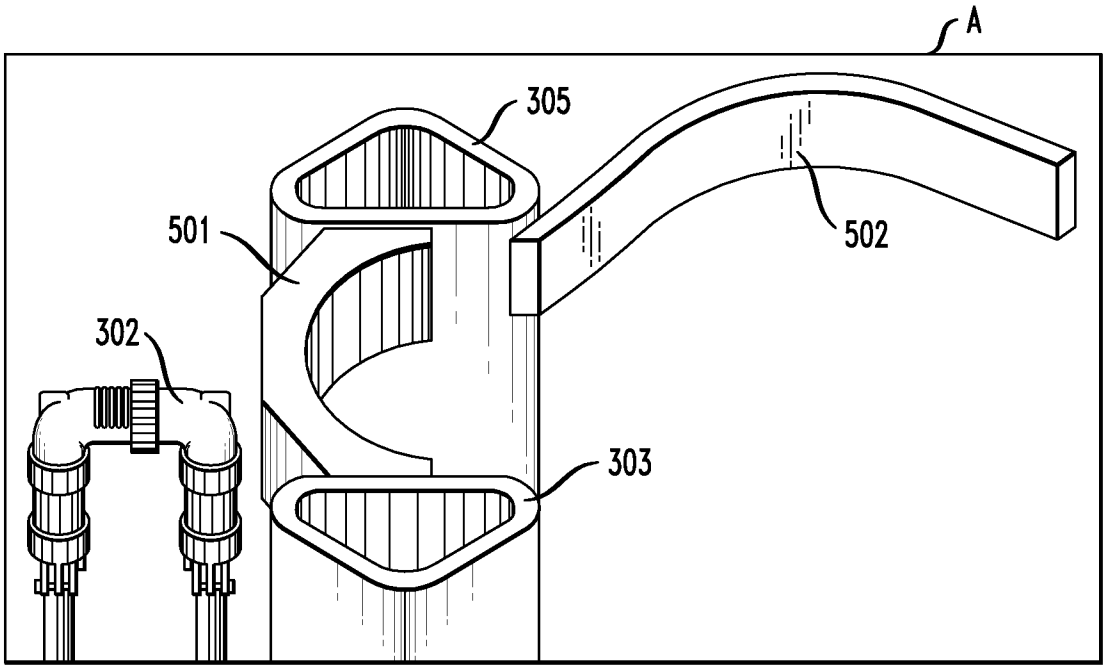
FIG. 5 depicts detailed view "A" of gas management system 220-*n*.

FIG. 5 depicts detailed view "A" of gas management system 220-*n*. View "A" represents the view from the forward end of uptake structures 303 and 305. View "A" depicts: umbilical cable 302; bracket 501; uptake structures 303 and 305; and restraint 502. All the components shown in view "A" are part of GMS 220-*n*.

Bracket 501 is a bracket that receives canistered munition 301 (not shown) when it is installed in gas management system 220-*n*.

In the illustrative embodiment, bracket 501 is physically connected to both uptake structures 303 and 305, but it will be clear to those having ordinary skill in the art, after reading the present disclosure, how to make and use alternative embodiments in which another component receives canistered munition 301; or in which bracket 501 is otherwise connected to one or more of the uptake structures or to other components of GMS 220-*n*.

Restraint 502 secures canistered munition 301 to GMS 220-*n* in a "closed" position. Restraint 502 is released when GMS 220-*n* is to receive a canistered munition or when a munition is to be removed from GMS 220-*n*, i.e., when GMS 220-*n* is in an "open" position. It will be clear to those having ordinary skill in the art, after reading the present disclosure, how to make and use alternative embodiments in which canistered munition 301 (not shown) is otherwise secured to GMS 220-*n* when it is in a "closed" position.

Restraint 502 is physically connected at one end to uptake structure 305, and is releasably coupled at the other end to uptake structure 303, according to the illustrative embodiment. In the illustrative embodiment, restraint 502 comprises padding that ensures a secure fit. It will be clear to those having ordinary skill in the art, after reading the present disclosure, how to make and use alternative embodiments in which another component secures canistered munition 301; or in which restraint 502 is otherwise connected to one or more of the uptake structures, or to another component of gas management system 220-*n*.

Figure 6:
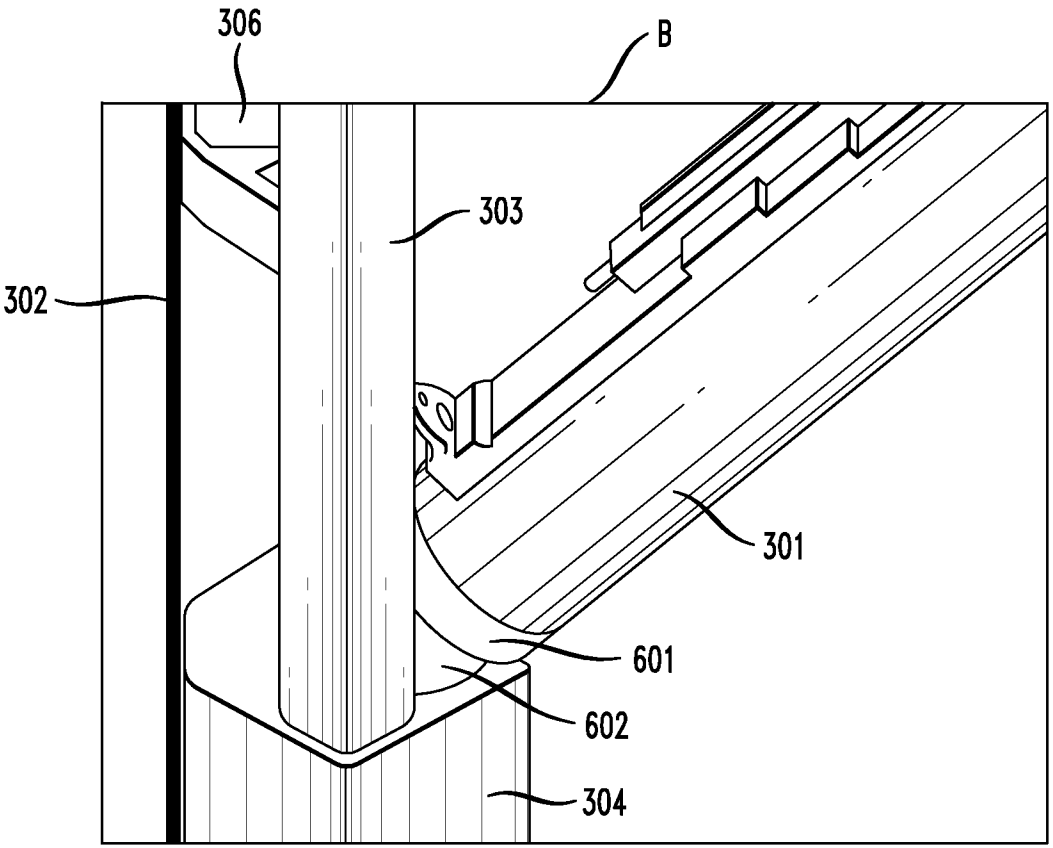
FIG. 6 depicts detailed view "B" of gas management system 220-*n*.

FIG. 6 depicts detailed view "B" of gas management system 220-*n* with canistered munition 301 installed. View "B" represents the view from the aft end of uptake structures 303 and 305 (not visible). View "B" depicts: umbilical cable 302; bracket 306; uptake structure 303; guide sleeve 601; canistered munition 301; plenum intake 602; and plenum 304. GMS 220-*n* comprises all the components depicted here, except for canistered munition 301.

Guide sleeve 601 is part of gas management system 220-*n* (not labeled). When GMS 220-*n* is in an "open" position, as illustrated in the present figure, guide sleeve 601 facilitates insertion and removal of canistered munition 301 to and from GMS 220-*n*, respectively.

Guide sleeve 601 removably receives canistered munition 301. Guide sleeve 601 is pivotably coupled to plenum 304 to pivot between an "open" position for receiving and removing a canistered munition, and a "closed" position for installation into a launch system and firing the munition. In the illustrative embodiment, guide sleeve 601 pivots via a removable claw (not shown), which enables guide sleeve 601 to be removed from plenum 304 to more conveniently (i) receive canistered munition 301, and (ii) remove canistered munition 301. The removable claw is coupled to a receiving structure or hinge (not shown) in plenum 304.

In some alternative embodiments, guide sleeve 601 is pivotably coupled to plenum 304 by a pin and weldment arrangement, but those having ordinary skill in the art will know many other ways of coupling these components, based on the freedom of movement sought and on any rotational needs associated with GMS 220-*n*. In some embodiments, guide sleeve 601 is not coupled to plenum 304, but instead, guide sleeve 601 removably rests on plenum 304, enabling guide sleeve 601 to be rocked or tilted to receive canistered munition 301.

When GMS 220-*n* is in a "closed" position, as illustrated in FIG. 3, guide sleeve 601 provides a sealing interface between plenum 304 and the atmosphere, such that the exhaust from a munition that is fired travels into plenum 304 without discharging or venting. The sealing interface prevents blow-back of the exhaust. To provide the sealing interface in the illustrative embodiment, guide sleeve 601 comprises sealing features (i) on an inner surface (not shown) that faces canistered munition 301, and (ii) on an outer surface that faces the exterior and plenum intake 602. Those having ordinary skill in the art will know many other ways of providing guide sleeve 601 with one or more sealing interface(s).

Plenum intake 602 receives the exhaust from canistered munition 301 into plenum 304. Plenum intake 602 is a gas management inlet. When GMS 220-*n* is in a "closed" position plenum intake 602 is sealed from the atmosphere by guide sleeve 601. When GMS 220-*n* is in an "open" position, plenum intake 602 is open to the atmosphere, as illustrated in the present figure. It will be clear to those having ordinary skill in the art, after reading the present disclosure, how to make and use alternative embodiments in which plenum intake 602 provides a sealing interface to guide sleeve 601. It will be clear to those having ordinary skill in the art, after reading the present disclosure, how to make and use alternative embodiments that comprise additional components disposed between plenum intake 602 and guide sleeve 601, such that a component other than guide sleeve 601 provides the seal to plenum intake 602.

FIG. 7 depicts enhanced munitions adapter 201 accommodating four GMSs 220-*n* in accordance with an illustrative embodiment. As depicted in the present figure, enhanced munitions adapter 201 is in a "closed" position for installation into a launch system and firing the munition(s).

Enhanced munitions adapter 201 receives and accommodates four GMSs 220-*n*. Enhanced munitions adapter 201 comprises: lateral restraint arms 710-*n*, wherein n=1, 2, 3, or 4; and base 711. It will be clear to those having ordinary skill in the art, after reading the present disclosure, that any disclosure herein in respect to a component n applies equally to other components of the same kind.

In the illustrative embodiment comprising ALS 112, enhanced munitions adapter 201 takes the place of munitions adapter 116 and is removably received by enclosure 114. In alternative embodiments, munitions adapter 116 in ALS 112 receives enhanced munitions adapter 201. In other alternative embodiments that do not comprise ALS 112, the launch system removably receives enhanced munitions adapter 201. It will be clear to those having ordinary skill in the art, after reading the present disclosure, how to make and use alternative embodiments of enhanced munitions adapter 201 that accommodate any number of GMS 220-*n*, e.g., two GMSs, three GMSs, etc., and any number of corresponding lateral restraint arms 710-*n*. It is to be understood that a canistered munition 301 need not be installed in every GMS 220-*n* that is accommodated by enhanced munitions adapter 201, or in any GMS 220-*n* for that matter.

Enhanced munitions adapter 201 is dimensioned, at least in part, based on the dimensions of the structure that is to receive it, e.g., ALS 112, enclosure 114, a launch system, another ship configuration, etc.

Lateral restraint arms 710-*n* are arranged to receive each of the respective GMS 220-*n*. In the illustrative embodiment, lateral restraint arm 710-*n* is physically connected to base 711, and is not connected to any other lateral restraint arm in enhanced munitions adapter 201. It will be clear to those having ordinary skill in the art, after reading the present disclosure, how to make and use lateral restraint arms 710-*n* such that they are physically connected to each other, or physically connected to the respective GMS 220-*n* or to components thereof. It will be clear to those having ordinary skill in the art, after reading the present disclosure, how to make and use alternative embodiments of enhanced munitions adapter 201 that comprise no lateral restraint arm 710-*n*, or that is otherwise constructed to receive the GMSs 220-*n*, such as a "cage," etc.

Base 711 provides support for the other components of enhanced munitions adapter 201 and for GMS 220-*n*. Base 711 is physically connected to lateral restraint arms 710-*n*. In some embodiments where enhanced munitions adapter 201 is disposed in enclosure 114 of ALS 112, base 711 comprises a sealing interface in accordance with the design of enclosure 114 and ALS 112. Base 711 further accommodates umbilical cable 302 for access to launch control electronics 118. It will be clear to those having ordinary skill in the art how to make and use base 711 to accommodate umbilical cable 302 for access to launch control electronics 118. It will be further clear to those having ordinary skill in the art, after reading the present disclosure, how to make and use base 711 to be consistent with the design of the systems or components that receive enhanced munitions adapter 201, e.g., enclosure 114, a launch system, a ship configuration, etc.

GMS 220-1 is visible in the present figure and comprises in part: uptake structure 303-1; plenum 304-1; and uptake structure 305-1. Canistered munition 301-1 is installed in GMS 220-1. GMS 220-1 and its component elements are described in more detail in FIGS. 3 through 6.

GMS 220-2, GMS 220-2, and GMS 220-3 are each identical to GMS 220-1, but are only partially visible in the present figure and, therefore, are not labeled. Canistered munitions 301-*n* are each installed in the respective GMS 220-*n*, wherein n=1, 2, 3, or 4.

In the illustrative embodiment, which comprises enhanced munitions adapter 201, each plenum 304-*n* is removably coupled to base 711. In some embodiments that comprise enhanced munitions adapter 201, plenum 304-*n* is pivotably coupled to base 711 to pivot between an "open" position for receiving and removing a canistered munition, and a "closed" position for installation into a launch system and firing the munition. In some embodiments that comprise enhanced munitions adapter 201, plenum 304-*n* is physically connected to lateral restraint arm 710-*n*. In some embodiments that comprise enhanced munitions adapter 201 each plenum 304-*n* physically abuts, but is not physically connected to, lateral restraint arm 710-*n*—as illustrated below in FIG. 8.

FIG. 8 depicts enhanced munitions adapter 201 in an "open" position. FIG. 8 depicts base 711 and lateral restraint arms 710-1, 710-2, 710-3, and 710-4, and installed canistered munitions 301-*n*.

Lateral restraint arms 710-1, 710-2, 710-3, and 710-4 are depicted in an "open" position relative to base 711. In some embodiments, the "open" position of enhanced munitions adapter 201 enables GMS 220-*n* to be removed and installed from and into enhanced munitions adapter 201. In some embodiments, the "open" position of enhanced munitions adapter 201 enables canistered munitions 301-*n* to be removed and installed from and into its respective GMS 220-*n*.

Four GMSs 220-*n* (not labeled), with installed canistered munitions 301-*n*, are depicted installed in enhanced munitions adapter 201. Some components of GMS 220-1 (not labeled) are visible, including, but not limited to: uptake structure 303-1; uptake structure 305-1; and plenum 304-1. Plenum 304-4 is also depicted in the present figure.

The materials used for GMS 220-*n* and for enhanced munitions adapter 201 largely depend on the application and on the type of munition to be accommodated. In the preferred embodiment, the outer components, such as lateral restraint arms 710-*n*, and base 711, use steel, but it will be clear to those having ordinary skill in the art how to identify and use alternative appropriate materials, such as aluminum, composites, etc., that are standards compliant. In the preferred embodiment, the inner components, such as plenum 304 and uptake structures 303 and 305, use ablative materials, but it will be clear to those having ordinary skill in the art how to identify and use alternative appropriate materials that suit the type of munition for which GMS 220-*n* is designed.

It is to be understood that the disclosure teaches just some examples of the illustrative embodiments and that many variations of the invention can easily be devised by those skilled in the art after reading this disclosure and that the scope of the present invention is to be determined by the following claims.

What is claimed is:

1. An apparatus comprising:

(a) a plenum that (i) is dimensioned and arranged to fluidically couple via a sealing interface to a first end of a canistered munition, and (ii) when fluidically coupled to the first end of the canistered munition via the sealing interface, receives the exhaust from the munition when the munition is fired, wherein the sealing interface prevents the exhaust from venting at the sealing interface; and (b) a first uptake structure that (i) is fluidically coupled to the plenum, and (ii) guides the exhaust from the plenum to the atmosphere;

wherein the apparatus removably receives the canistered munition, and wherein the apparatus is at least partially removable from a vertical launch system to receive the canistered munition, and wherein the dimensions of the plenum and of the first uptake structure are based on the dimensions of the canistered munition, and wherein the plenum and the first uptake structure collectively define a gas management system for the canistered munition.

2. The apparatus of claim 1 further comprising:

an enhanced munitions adapter that accommodates a plurality of canistered munitions, wherein:

(i) each canistered munition is operatively coupled to a respective gas management system, and wherein each gas management system operates independently, and (ii) the vertical launch system removably receives the enhanced munitions adapter.

3. The apparatus of claim 1 further comprising:

an enhanced munitions adapter that accommodates a plurality of canistered munitions, wherein:

(i) each canistered munition is operatively coupled to a respective gas management system, and wherein each gas management system operates independently, (ii) the enhanced munitions adapter is removably receivable by an enclosure in a cell of the vertical launch system, wherein the enclosure comprises a sealing bulkhead that separates the enclosure into a munitions compartment and an electronics compartment, (iii) the enhanced munitions adapter is disposed in the munitions compartment, and (iv) the enclosure is at least partially removable from the cell.

4. The apparatus of claim 1 wherein the gas management system further comprises a second uptake structure, wherein the second uptake structure:

(i) is fluidically coupled to the plenum; and (ii) guides the exhaust from the plenum to the atmosphere.

5. The apparatus of claim 1 wherein the first uptake structure is disposed alongside the canistered munition.

6. The apparatus of claim 1 wherein the first uptake structure guides the exhaust in the direction of a hatch assembly in the vertical launch system.

7. The apparatus of claim 1 wherein the vertical launch system is one of a MK 41 VLS and a MK 57 VLS.

8. The apparatus of claim 1 wherein the gas management system is not concentric relative to the canistered munition.

9. The apparatus of claim 1 wherein the canistered munition is an energetic munition.

10. An apparatus for use in a single-cell vertical launch system that is suitable for use as a guest launcher within a host launcher, the apparatus comprising:

an enhanced munitions adapter that accommodates a plurality of canistered munitions, wherein:

(i) each canistered munition is operatively coupled to a respective gas management system, and wherein each gas management system operates independently, (ii) the enhanced munitions adapter is removably receivable by an enclosure in a cell of the vertical launch system, wherein the enclosure comprises a sealing bulkhead that separates the enclosure into a munitions compartment and an electronics compartment, (iii) the enhanced munitions adapter is disposed in the munitions compartment, and (iv) each gas management system comprises:

(a) a plenum that (i) is dimensioned and arranged to fluidically couple via a sealing interface to a first end of a canistered munition, and (ii) when fluidically coupled to the first end of the canistered munition via the sealing interface, receives the exhaust from the munition when the munition is fired, wherein the sealing interface prevents the exhaust from venting at the sealing interface, and (b) a first uptake structure that (i) is fluidically coupled to the plenum, and (ii) guides the exhaust from the plenum to the atmosphere;

wherein each gas management system removably receives the respective canistered munition; and wherein the dimensions of the plenum and of the first uptake structure are based on the dimensions of the respective canistered munition.

11. The apparatus of claim 10 wherein the enhanced munitions adapter is at least partially removable from the munitions compartment to receive at least one of the canistered munitions.

12. The apparatus of claim 10 wherein each gas management system further comprises a second uptake structure, wherein the second uptake structure:

(i) is fluidically coupled to the plenum; and (ii) guides the exhaust from the plenum to the atmosphere.

13. The apparatus of claim 10 wherein the first uptake structure is disposed alongside the respective canistered munition.

14. The apparatus of claim 10 wherein the first uptake structure guides the exhaust in the direction of a top frame of the guest launcher in the vertical launch system.

15. The apparatus of claim 10 wherein one of a MK 41 VLS and a MK 57 VLS comprises the host launcher.

16. The apparatus of claim 10 wherein the gas management system is not concentric relative to the canistered munition.

17. The apparatus of claim 10 wherein at least one canistered munition of the plurality of canistered munitions is an energetic munition.

18. An apparatus for use in a vertical launch system, the apparatus comprising:

(a) a plenum that (i) is dimensioned and arranged to fluidically couple via a sealing interface to a first end of a canistered munition, and (ii) when fluidically coupled to the first end of the canistered munition via the sealing interface, receives the exhaust from the munition when the munition is fired, wherein the sealing interface prevents the exhaust from venting at the sealing interface;

(b) a first uptake structure that (i) is fluidically coupled to the plenum, and (ii) guides the exhaust from the plenum to the atmosphere;

(c) a second uptake structure that (i) is fluidically coupled to the plenum, and (ii) guides the exhaust from the plenum to the atmosphere;

wherein the apparatus removably receives the canistered munition;

wherein the apparatus is at least partially removable from the vertical launch system to receive the canistered munition;

wherein the plenum, the first uptake structure, and the second uptake structure collectively define a gas management system for the canistered munition; and wherein the dimensions of the gas management system are based on the dimensions of the canistered munition.

19. The apparatus of claim 18 further comprising:

an enhanced munitions adapter that accommodates a plurality of canistered munitions, wherein:

(i) each canistered munition is operatively coupled to a respective gas management system, and wherein each gas management system operates independently, and (ii) the vertical launch system removably receives the enhanced munitions adapter.

20. The apparatus of claim 18 further comprising:

an enhanced munitions adapter that accommodates a plurality of canistered munitions, wherein:

(i) each canistered munition is operatively coupled to a respective gas management system, and wherein each gas management system operates independently, (ii) the enhanced munitions adapter is removably receivable by an enclosure in a cell of the vertical launch system, wherein the enclosure comprises a sealing bulkhead that separates the enclosure into a munitions compartment and an electronics compartment, (iii) the enhanced munitions adapter is disposed in the munitions compartment, and (iv) the enclosure is at least partially removable from the cell.

21. The apparatus of claim 18 wherein the first uptake structure and the second uptake structure are disposed alongside the respective canistered munition.

22. The apparatus of claim 18 wherein the first uptake structure and the second uptake structure guide the exhaust in the direction of a hatch assembly in the vertical launch system.

23. The apparatus of claim 18 wherein the gas management system is not concentric relative to the canistered munition.

24. The apparatus of claim 18 wherein at least one canistered munition of the plurality of canistered munitions is an energetic munition.

25. The apparatus of claim 18 wherein the vertical launch system is one of a MK 41 VLS and a MK 57 VLS.

* * * * *